US007048608B2

(12) United States Patent
Boyd et al.

(10) Patent No.: US 7,048,608 B2
(45) Date of Patent: May 23, 2006

(54) SEMICONDUCTOR WAFER MATERIAL REMOVAL APPARATUS AND METHOD FOR OPERATING THE SAME

(75) Inventors: John Boyd, Atascadero, CA (US); Fred C. Redeker, Fremont, CA (US); Yezdi Dordi, Palo Alto, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/948,510

(22) Filed: Sep. 22, 2004

(65) Prior Publication Data

US 2006/0063470 A1 Mar. 23, 2006

(51) Int. Cl.
*B24B 49/00* (2006.01)
*B24B 7/22* (2006.01)

(52) U.S. Cl. ..... 451/5; 451/41

(58) Field of Classification Search ..... 451/5, 451/9, 10, 11, 24, 541, 41
See application file for complete search history.

(56) References Cited

U.S. PATENT DOCUMENTS 6,265,314 B1 * 7/2001 Black et al. ..... 438/690
6,280,292 B1 * 8/2001 Sato et al. ..... 451/9
6,450,859 B1 * 9/2002 Moyer ..... 451/5

* cited by examiner

*Primary Examiner*—Robert A. Rose
(74) *Attorney, Agent, or Firm*—Martine Penilla & Gencarella, LLP

(57) ABSTRACT

A system for applying a microtopography to a semiconductor wafer ("wafer") is provided. The system includes a chuck configured to hold and rotate the wafer. The system also includes a grinding wheel disposed over the chuck in a proximately adjustable manner relative to the wafer to be held by the chuck. The grinding wheel is configured to rotate about a central axis of the grinding wheel, wherein the central axis of the grinding wheel is non-parallel to the central axis of the chuck. The grinding wheel is capable of contacting the wafer and removing material from the wafer at the area of contact. Appropriate application of the grinding wheel to the wafer serves to generate a microtopography across the wafer surface. The resulting microtopography can then be planarized more effectively by conventional chemical mechanical planarization methods.

32 Claims, 7 Drawing Sheets

SEMICONDUCTOR WAFER MATERIAL REMOVAL APPARATUS AND METHOD FOR OPERATING THE SAME

CROSS REFERENCE TO RELATED APPLICATIONS

This application is related to U.S. patent application Ser. No. 10/816,504, filed on Mar. 31, 2004, and entitled "Compliant Grinding Wheel." This application is also related to U.S. patent application Ser. No. 10/816,417, filed on Mar. 31, 2004, and entitled "Pre-Planarization System and Method." This application is also related to U.S. patent application Ser. No. 10/256,055, filed on Sep. 25, 2002, and entitled "Enhancement of Eddy Current Based Measurement Capabilities." This application is also related to U.S. patent application Ser. No. 10/749,531, filed on Dec. 30, 2003, and entitled "Method and Apparatus of Arrayed, Clustered or Coupled Eddy Current Sensor Configuration for Measuring Conductive Film Properties." The disclosures of these related applications are incorporated herein by reference.

BACKGROUND OF THE INVENTION

1. Field of the Invention

The present invention relates to semiconductor fabrication.

2. Description of the Related Art

During copper interconnect manufacturing, a copper layer is deposited on a seed/barrier layer using an electroplating process. Components in the electroplating solution provide for appropriate gap fill on sub-micron features. However, these sub-micron features tend to plate faster than the bulk areas and larger, i.e., greater than 1 micrometer, trench regions. The sub-micron regions are typically found in large memory arrays such as, for example, static random access memory (SRAM), and can span large areas of the wafer. It should be appreciated that this causes large areas of the wafer to have additional topography that needs to be planarized, in addition to the larger trench regions that also need to be planarized.

FIG. 1 is a simplified schematic diagram illustrating a silicon substrate having a copper layer deposited thereon. A copper layer 103 is deposited on a seed/barrier layer disposed over silicon wafer 101 using an electroplating process. As previously mentioned, components in the electroplating solution provide for good gap fill on sub-micron features, such as sub-micron trenches in region 105, but these features tend to plate faster than the bulk areas and trench regions 107 and 109. High regions or "steps" in the topography of the substrate, illustrated by region 111, result over the sub-micron trench region 105. These steps are also referred to as "superfill" regions. The superfill region 111 is defined by thicker copper film than field regions 108 and trench regions 107 and 109. The superfill regions 111 must be planarized along with the topography over the field regions 108 and trench regions 107 and 109.

Current planarization techniques are not suited to handle the superfill topography in an efficient manner, i.e., planarization techniques are sensitive to pattern density and circuit layout. More specifically, chemical mechanical planarization (CMP) processes often must be tuned according to the incoming wafer properties. Therefore, changes are made to the CMP process (such as changing step times, overpolish time, or endpoint algorithms, for example) in order to accommodate variations within or between wafer lots. Also, such changes are made to the CMP process to accommodate different pattern densities and circuit layouts encountered on wafers of mixed-product manufacturing lines.

When attempting to perform a single CMP process on the topography having superfill regions, excessive dishing and erosion can occur in trench regions 107 and 109 when overpolishing is performed in order to completely remove the remaining copper from the superfill region 111. Additionally, not only is the CMP process required to remove the excess copper in the region 111, but the CMP process is also required to perform this removal in a manner that follows a contour of the substrate. The contour of the substrate is due to waviness inherent to the silicon substrate. The waviness is typically on the order of 0.2 micrometer to 0.5 micrometer total thickness variation. Current CMP processes do not suitably deal with both superfill region topography and substrate contour, while effectively planarizing the other topography in the trench and field regions. In an ideal case, the copper film to be removed would consist of a uniformly thick conformal film including a homogeneous pattern layout and density.

In view of the foregoing, a solution is needed to effectively and efficiently remove material from a semiconductor wafer having large topographical variations.

SUMMARY OF THE INVENTION

In one embodiment, an apparatus for removing a material from a semiconductor wafer is disclosed. The apparatus includes a chuck configured to hold the semiconductor wafer. The chuck is also configured to rotate about a central axis of the chuck. The apparatus further includes a grinding wheel disposed over the chuck. The grinding wheel is configured to be positioned in a proximately adjustable manner relative to the semiconductor wafer to be held by the chuck. The grinding wheel is also configured to rotate about a central axis of the grinding wheel. The central axis of the grinding wheel is oriented to be non-parallel to the central axis of the chuck. The grinding wheel is capable of removing material from the semiconductor wafer at a contact area between the grinding wheel and the semiconductor wafer.

In another embodiment, a system for establishing a micro-topography across a semiconductor wafer is disclosed. The system includes a wafer support structure configured to hold a wafer and rotate the wafer about a centerpoint of the wafer support structure. A grinding wheel is also included in the system. The grinding wheel is configured to rotate about a grinding wheel axis that is non-perpendicular to the wafer support structure. The grinding wheel has a working surface defined to removal material from a surface of the wafer when positioned to contact the surface of the wafer. The system further includes metrology disposed to monitor the surface of the wafer. The metrology is defined to provide information descriptive of the surface of the wafer to be contacted by the working surface of the grinding wheel.

In another embodiment, a method for pre-planarizing a semiconductor wafer is disclosed. The method includes operations for holding a wafer on a surface of a chuck and rotating the chuck. The method also includes an operation for rotating a grinding wheel about a grinding wheel axis that is oriented to be non-perpendicular to the surface of the chuck upon which the wafer is held. The method further includes an operation for moving the grinding wheel to contact the wafer at a specific location. The grinding wheel is then allowed to remove material from a surface of the wafer at the specific location.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1:
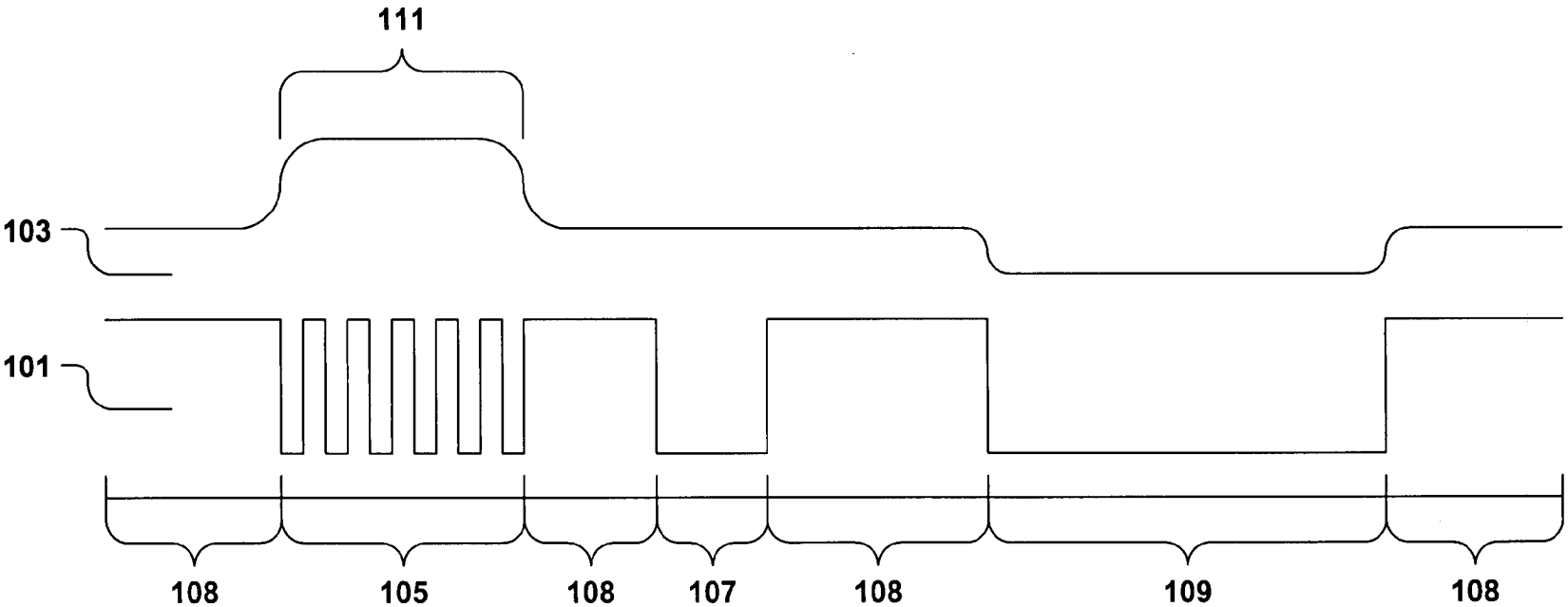
FIG. 1 is a simplified schematic diagram illustrating a silicon substrate having a copper layer deposited thereon.
Figure 2A:
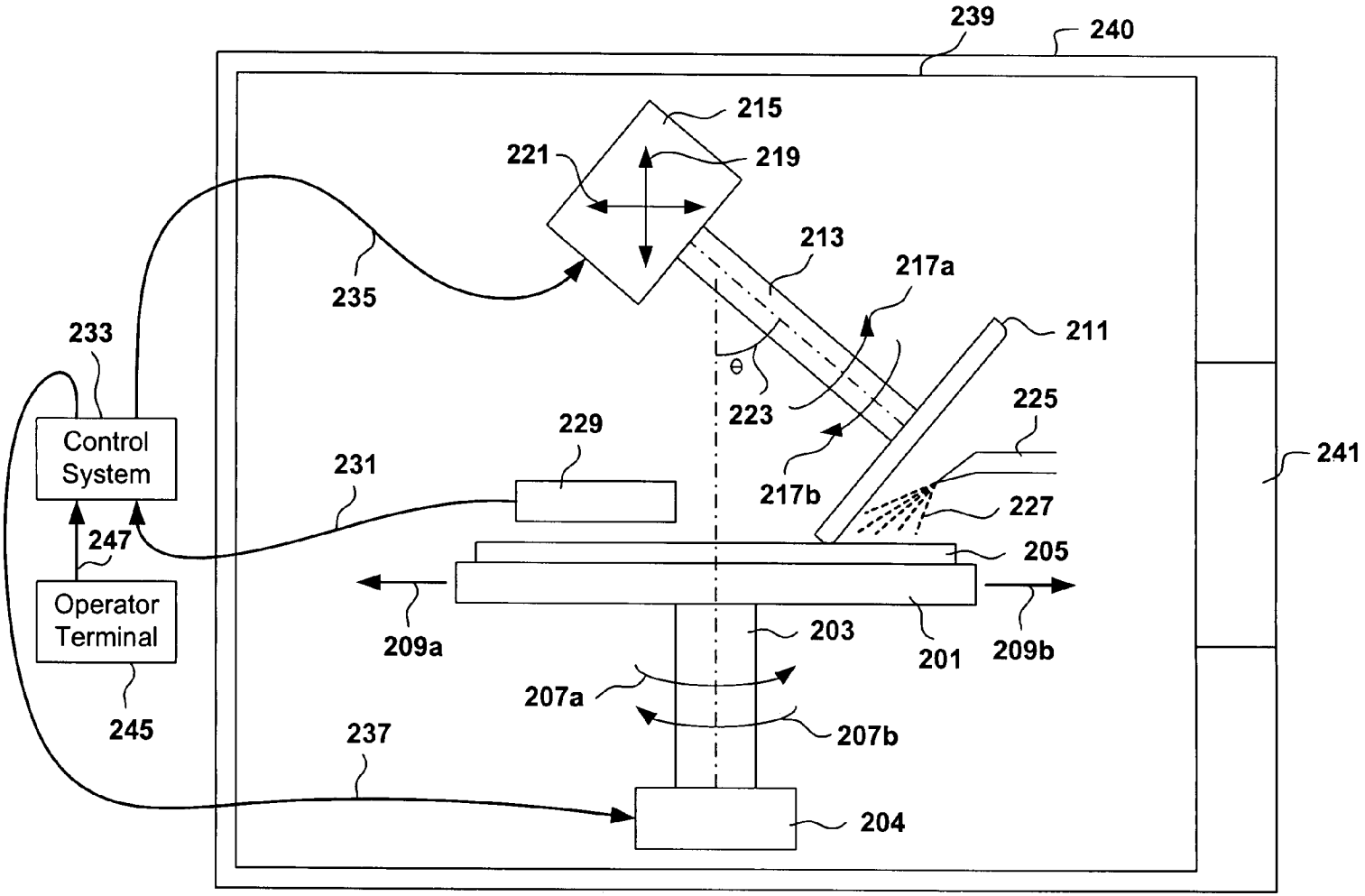
FIG. 2A is an illustration showing an apparatus for removing a material from a semiconductor wafer, in accordance with one embodiment of the present invention.

FIG. 2A is an illustration showing an apparatus for removing a material from a semiconductor wafer, in accordance with one embodiment of the present invention. The apparatus includes a wafer support structure ("chuck") 201 configured to hold the semiconductor wafer ("wafer") 205. In one embodiment, the chuck 201 is configured to hold the wafer 205 by applying a partial vacuum to a backside of the wafer 205. However, it should be appreciated that in other embodiments the chuck 201 can be defined to use any other mechanism for holding the wafer 205 to the chuck 201. For example, in another embodiment, clips may be used to hold the wafer 205 to the chuck 201. Also, in one embodiment, the chuck 201 is disk shaped with a diameter that is slightly larger than a diameter of the wafer 205 which is also disk shaped.

The chuck 201 is connected to a shaft 203 such that an axis of the shaft 203 is substantially coincident with a central axis of the chuck 201, wherein the central axis of the chuck 201 is defined through a centerpoint of the chuck 201. The shaft 203/chuck 201 are configured to rotate about the central axis of the chuck 201, as indicated by arrows 207*a* and 207*b*. In one embodiment, the chuck 201 is configured to rotate about the central axis of the chuck 201 at a rate within a range extending up to about 200 revolutions per minute (RPM). In another embodiment, the chuck 201 is configured to rotate at a rate within a range extending from about 5 RPM to about 200 RPM. In yet another embodiment, the chuck 201 is configured to rotate at about 10 RPM. It should be understood that the term "about" as used herein means plus or minus ten percent of a specified value. Additionally, the shaft 203 is connected to a horizontal adjustment mechanism 204 configured to move the shaft 203/chuck 201 in a horizontal direction, as indicated by arrows 209*a* and 209*b*. It should be appreciated that the movement imparted to the shaft 203/chuck 201 by the horizontal adjustment mechanism 204 is precisely controlled. Also, movement of the shaft 203/chuck 201 by the horizontal adjustment mechanism is performed in a manner that avoids movement of the shaft 203/chuck 201 in a vertical direction.

The apparatus further includes a grinding wheel 211 disposed over the chuck 201 in a proximately adjustable manner relative to the wafer 205 to be held by the chuck 201. In various exemplary embodiments, the grinding wheel 211 can be defined by a solid disk, a semi-solid disk, a ring having spokes extending to a central hub, a toroidal wheel, or a spherical/hemi-spherical wheel. It should be appreciated that the grinding wheel 211 can also assume other configurations not specifically described herein so long as the functionality of the grinding wheel 211 is consistent with that described herein. Regardless of the particular grinding wheel 211 configuration, the grinding wheel 211 is connected to a shaft 213 such that an axis of the shaft 213 is substantially coincident with a central axis of the grinding wheel 211, wherein the central axis of the grinding wheel 211 is defined through a centerpoint of the grinding wheel 211. The shaft 213/grinding wheel 211 are configured to rotate about the central axis of the grinding wheel 211, as indicated by arrows 217*a* and 217*b*. In one embodiment, the grinding wheel 211 is configured to rotate at a rate within a range extending from about 300 RPM to about 40000 RPM. In another embodiment, the grinding wheel 211 is configured to rotate at a rate within a range extending from about 3000 RPM to about 10000 RPM. In yet another embodiment, the grinding wheel 211 is configured to rotate at a rate within a range extending from about 4000 RPM to about 5000 RPM.

The shaft 213/grinding wheel 211 is also configured to be oriented at an angle relative to the chuck 201, and hence wafer 205. More specifically, the central axis of the grinding wheel 211 can be oriented to be non-parallel to the central axis of the chuck 201 such that an angle θ 223 exists between the central axis of the grinding wheel 211 and the central axis of the chuck 201. Additionally, the shaft 213 is connected to a position and orientation adjustment mechanism 215. The position and orientation adjustment mechanism 215 is configured to move the shaft 213/grinding wheel 211 in both a horizontal direction and a vertical direction relative to the chuck 201, as indicated by arrows 221 and 219, respectively. It should be appreciated that the movement imparted to the shaft 213/grinding wheel 211 by the position and orientation adjustment mechanism 215 is precisely controlled. For example, in one embodiment, the position and orientation adjustment mechanism 215 is defined to maintain the grinding wheel at a specific height relative to the chuck 201 within a tolerance of less than 0.1 micrometer. Additionally, the position and orientation adjustment mechanism 215 is configured to precisely adjust and maintain the angle θ 223 between the central axis of the grinding wheel 211 and the central axis of the chuck 201.

The grinding wheel 211 is capable of removing material from the wafer 205 at a contact area between the grinding wheel 211 and the wafer 205. The grinding wheel 211 includes a working surface configured to remove the material from the wafer 205 at the contact area. In one embodiment, the working surface is defined by exposed fixed abrasive material secured within a binding matrix. It should be appreciated, however, that the working surface of the grinding wheel 211 can be defined in essentially any manner that provides for mechanical removal of material from the wafer 205 when placed in rotary contact with the wafer 205. In one embodiment, the fixed abrasive material is diamond. In this embodiment, the fixed abrasive material, i.e., diamond, is configured to impart scratches to the wafer 205 when placed in rotary contact with the wafer 205. However, the scratches are imparted with a scratch depth of less than about 0.25 micrometer and a width of less than about 2 micrometers. Additionally, in one embodiment, the working surface of the grinding wheel 211 is defined to have a curved profile. As the working surface having the curved profile is applied to the wafer 205, while maintaining the grinding wheel 211 at the angle θ 223 greater than zero, a radial portion of the working surface curved profile is made to contact the surface of the wafer 205.

In another embodiment, the grinding wheel 211 can be defined to include a single point abrasive. For example, the single point abrasive can be a single diamond set in the binding matrix. In this embodiment, the grinding wheel 211 can be controlled to rotate at rate within a range extending from about 30000 RPM to about 40000 RPM. It should be appreciated that use of the single point abrasive can provide for superior control of the contact area between the fixed abrasive and the wafer 205.

It should be appreciated that the high velocity of the grinding wheel 211 and the limited contact area between the grinding wheel 211 and the wafer 205 provide for low overall material film stress across the wafer 205 surface. Also, the overall material film stress across the wafer 205 surface is further limited by amortization of stress induced by small instantaneous contact regions from the individual abrasive material in the grinding matrix over the entire wafer surface. The low overall material film stress imparted to the wafer 205 surface by the grinding wheel apparatus serves to prevent delamination of film materials such as copper.

Furthermore, due to the hardness differential and low overall stress and effective down-force required between the fixed abrasive material and the wafer surface material, the grinding wheel apparatus of the present invention can be configured in a compact, light-weight manner using small bearings. Thus, the grinding apparatus of the present invention is capable of providing more precise grinding results relative to conventional wafer processing equipment that requires larger heavy-duty bearings and robust framework for preventing tool vibration modes. Also, the light-weight, compact features of the grinding apparatus can be useful when incorporating the grinding apparatus into existing modular wafer processing systems.

The contact area between the grinding wheel 211 and the wafer 205 is defined by a radius of the grinding wheel, the radius of the curved profile of the working surface of the grinding wheel 211, and the angle θ 223 subtended by the central axis of the grinding wheel and the central axis of the chuck 201. Also, it should be appreciated that the contact area can be defined to have a length, i.e., a planarization length, that is less than the diameter of the wafer 205. A more detailed discussion of the contact area dependence on grinding wheel diameter, working surface profile, and grinding wheel angle is provided below with respect to FIGS. 3A–3C.

Further with regard to FIG. 2A, a rinse nozzle 225 can be disposed over the chuck 201 in a manner that allows fluid 227 emanating from the rinse nozzle 225 to be directed toward a surface of the wafer 205 upon which the grinding wheel 211 is applied. The fluid 227 serves to provide lubrication between the grinding wheel 211 and the wafer 205, to cool the wafer 205, and to transport material (swarf) removed from the wafer 205 off of the wafer 205. It should be appreciated that the fluid 227 is not required to have the chemical reactant and abrasive properties of a slurry as used in conventional chemical mechanical planarization processes. Rather, the fluid 227 is preferred to be inert with respect to materials present on the wafer 205 surface. In one embodiment, the fluid 227 is deionized water. In certain embodiments, corrosion inhibitors can be incorporated into the fluid 227, if required.

It should be appreciated that the grinding wheel apparatus of the present invention does not require slurry and polishing pad consumables, as required with conventional chemical mechanical polishing (CMP) equipment and processes. Those skilled in the art will appreciate that the cost of consumables, i.e., slurry and polishing pads, used in conventional CMP processes can be expensive. In contrast the grinding wheel apparatus and associated process of the present invention simply uses deionized water as described above with respect to the fluid 227. Additionally, due to the material hardness differential between the fixed abrasive material of the grinding wheel and the wafer material being impacted thereby, the grinding wheel is expected to last through an extensive amount of grinding evolutions without needing reconditioning or replacement. It is conceivable that a properly maintained grinding wheel may not ever require replacement. Therefore, in contrast to the polishing pad of the conventional CMP equipment, the grinding wheel of the present invention may not be considered as a consumable item. Thus, the grinding wheel apparatus and associated process of the present invention requires a substantially reduced cost of consumables.

Metrology 229 is also disposed over the wafer 205 to monitor the surface of the wafer 205. The metrology 229 is defined to provide information descriptive of the surface of the wafer 205 to be contacted by the working surface of the grinding wheel 211. In one embodiment, the metrology 229 is defined to measure a thickness of a particular material present on the surface of the wafer 205. In one exemplary implementation of this embodiment, eddy current technology can be used to measure the thickness of the particular material present on the surface of the wafer 205. A description of eddy current technology and features is provided in the following co-pending patent applications: "Enhancement of Eddy Current Based Measurement Capabilities," U.S. patent application Ser. No. 10/256,055, filed on Sep. 25, 2002, and "Method and Apparatus of Arrayed, Clustered or Coupled Eddy Current Sensor Configuration for Measuring Conductive Film Properties," U.S. patent application Ser. No. 10/749,531, filed on Dec. 30, 2003.

Based on the measured thickness of the particular material provided by the metrology 229, the orientation and position of the grinding wheel 211 with respect to the chuck 205/wafer 205 can be adjusted as necessary to meet process requirements with respect to material removal from the wafer 205. It should be appreciated that the metrology 229 can be defined to include a single sensor or an array of sensors, as appropriate for the particular wafer process.

In one embodiment, data collected by the metrology 229 is sent to a control system 233, as indicated by arrow 231. In one embodiment, the control system 223 is a computer. The control system 233 is defined to receive process requirements input from an operator terminal 245, as indicated by arrow 247. The control system 233 is further configured to analyze the data collected by the metrology 229 to determine if any adjustment to the apparatus configuration is required to satisfy the process requirements input. If the analysis by the control system 233 indicates that adjustments to the apparatus configuration are required, the control system 233 will send appropriate control signals to the position and orientation adjustment mechanism 215 and/or the horizontal adjustment mechanism 204, as indicated by arrows 235 and 237, respectively.

For example, the metrology 229 can send feedback to the position and orientation adjustment mechanism 215 via the control system 233. The feedback provides information about a thickness of a material present on the surface of the wafer 205, wherein the material is in line to be contacted by the grinding wheel 211. The position and orientation adjustment mechanism 215 can then act as a vertical adjustment control to adjust a distance between the grinding wheel 211 and the wafer 205, according to the feedback received from the metrology 229, such that the material is removed by the grinding wheel 211 in accordance with appropriate process requirements, such as removing a specific amount of the film so as to leave a desired remaining thickness of film in that region.

More specifically, in the above-described example, the metrology 229 is operated to measure the thickness of the material on the wafer 205 surface at a particular location defined by a set of coordinates, such as cylindrical (radius and angle) or Cartesian (x and y). As the wafer 205 rotates, the particular measured location moves under the grinding wheel. However, prior to movement of the particular measured location under the grinding wheel, the measured material thickness at the particular location is used to adjust the grinding wheel elevation relative to the wafer 205 such that a desired amount of material removal can be achieved at the particular location. It should be appreciated that removal of the material from the particular location can be performed in an incremental manner to achieve the required material thickness. For example, as the wafer 205 rotates, the material thickness is measured at the particular location before and after traversal of the particular location beneath the grinding wheel. Thus, material thickness measurements are made to determine material removal requirements and material removal results as the wafer rotates. Also, the measurements at the particular location before and after traversal beneath the grinding wheel can be used to fine tune the grinding wheel response and accuracy as part of an ongoing calibration routine. It should be appreciated that the rate of rotation of the wafer 205 can be controlled to allow for optimum efficiency in obtaining measurements from the metrology 229 and adjusting the grinding wheel elevation accordingly, prior to traversal of the particular measured location beneath the grinding wheel.

In an alternate embodiment, a map of the material, i.e., film, thickness across the wafer 205 is generated prior to the grinding process. In this embodiment, the map of material thickness is delineated by a coordinate system such as cylindrical or Cartesian. Thus, the film thickness is known at each location on the wafer. The grinding wheel can be configured to appropriately remove material from a particular location on the wafer based on the map of material thickness. The particular location on the wafer can then be moved in a linear manner to traverse beneath the rotating grinding wheel. It should be appreciated that in this alternate embodiment rotation of the wafer 205 is not required.

In one embodiment, the apparatus of FIG. 2A is situated within a process enclosure 239. The process enclosure 239 provides for environmental control within a vicinity of the wafer 205 processing. Also, the apparatus and process enclosure 239 can be contained within a process module 240. The process module 240 is equipped with a wafer handler access device 241 to allow for positioning of the wafer 205 on the chuck 201 and removal of the wafer 205 from the chuck 201. It should be appreciated that the apparatus of FIG. 2A can be adapted to operate in conjunction with essentially any process enclosure 239 technology, process module 240 technology, wafer handler access device 241 technology, and wafer handling technology.

Figure 2B:
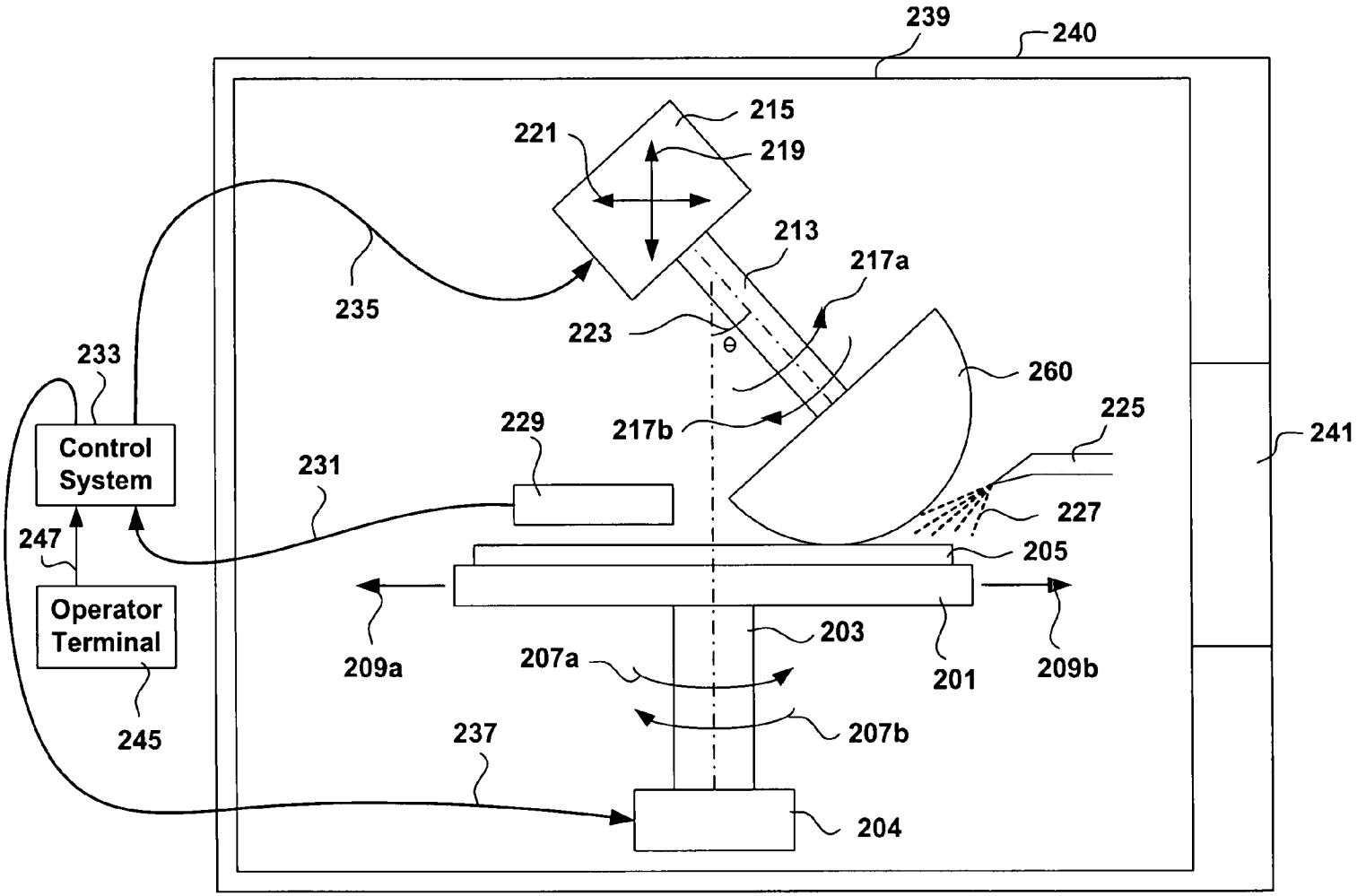
FIG. 2B is an illustration showing the apparatus of FIG. 2A with incorporation of a hemispherical grinding wheel, in accordance with one embodiment of the present invention.

As previously mentioned, the grinding wheel incorporated into the grinding wheel apparatus of the present invention can be defined to have one of many different shapes. For example, FIG. 2B is an illustration showing the apparatus of FIG. 2A with incorporation of a hemispherical grinding wheel 260, in accordance with one embodiment of the present invention. Each of the components shown in FIG. 2B is the same as described with respect to FIG. 2A. It should be appreciated that grinding wheels of different shapes will have different contact area response functions, wherein each contact area response function is dependent on the shape and size of the grinding wheel and the angle subtended by the grinding wheel axis and chuck axis.

Figure 3A:
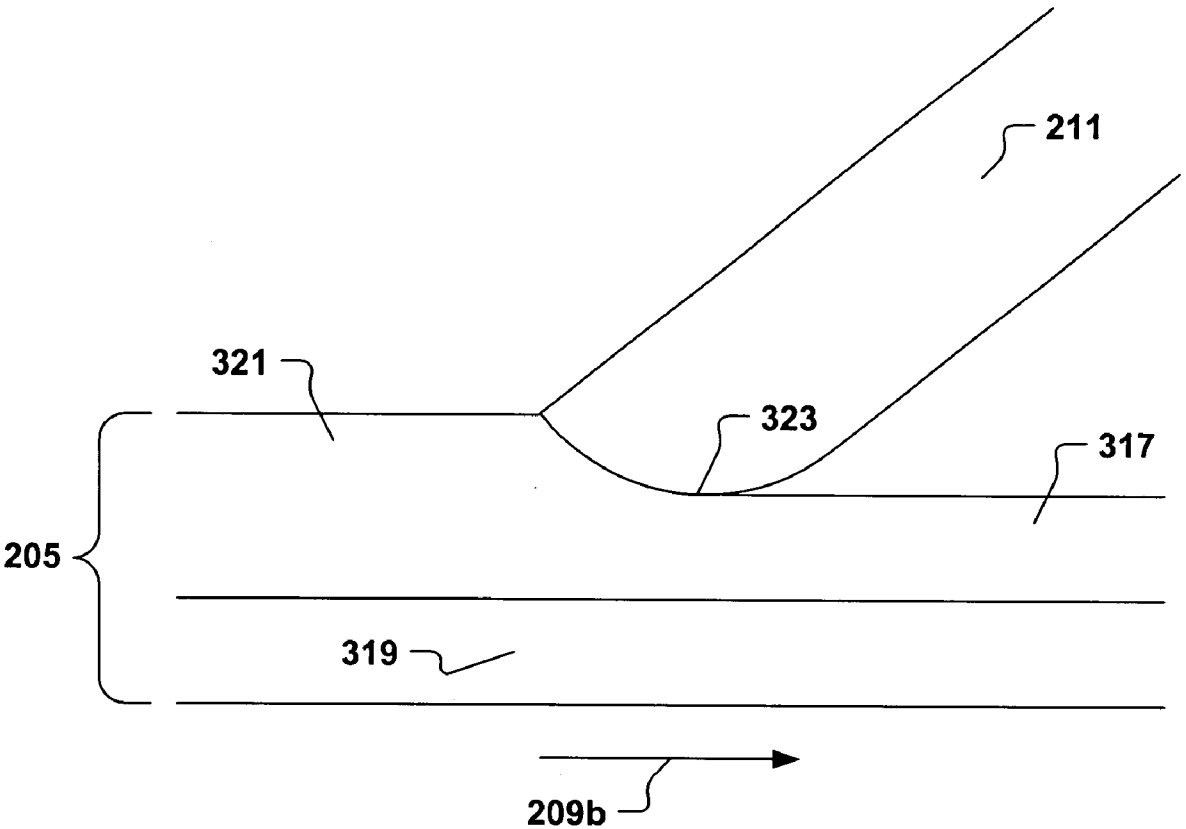
FIG. 3A is an illustration showing a cross-sectional view of the grinding wheel contacting the wafer, in accordance with one embodiment of the present invention.

FIG. 3A is an illustration showing a cross-sectional view of the grinding wheel 211 contacting the wafer 205, in accordance with one embodiment of the present invention. The wafer includes a metal layer 317 overlying a substrate 319. In one embodiment, the metal layer 317 is defined by copper. The metal layer 317 includes a region 321 to be removed through application of the grinding wheel 211. The grinding wheel 211 is set at an appropriate elevation above the wafer 205 to contact the region 321 as the wafer 205 is moved horizontally in the direction of arrow 209*b*. As the wafer 205 is moved in the direction of arrow 209*b*, a working surface 323 of the grinding wheel 211 contacts the region 321 and removes the material of region 321 from the wafer 205. Since the working surface 323 has a radial profile, it is necessary for the wafer and the grinding wheel 211 to traverse horizontally with respect to each other in order to obtain the desired metal layer 317 thickness.

Figure 3B:
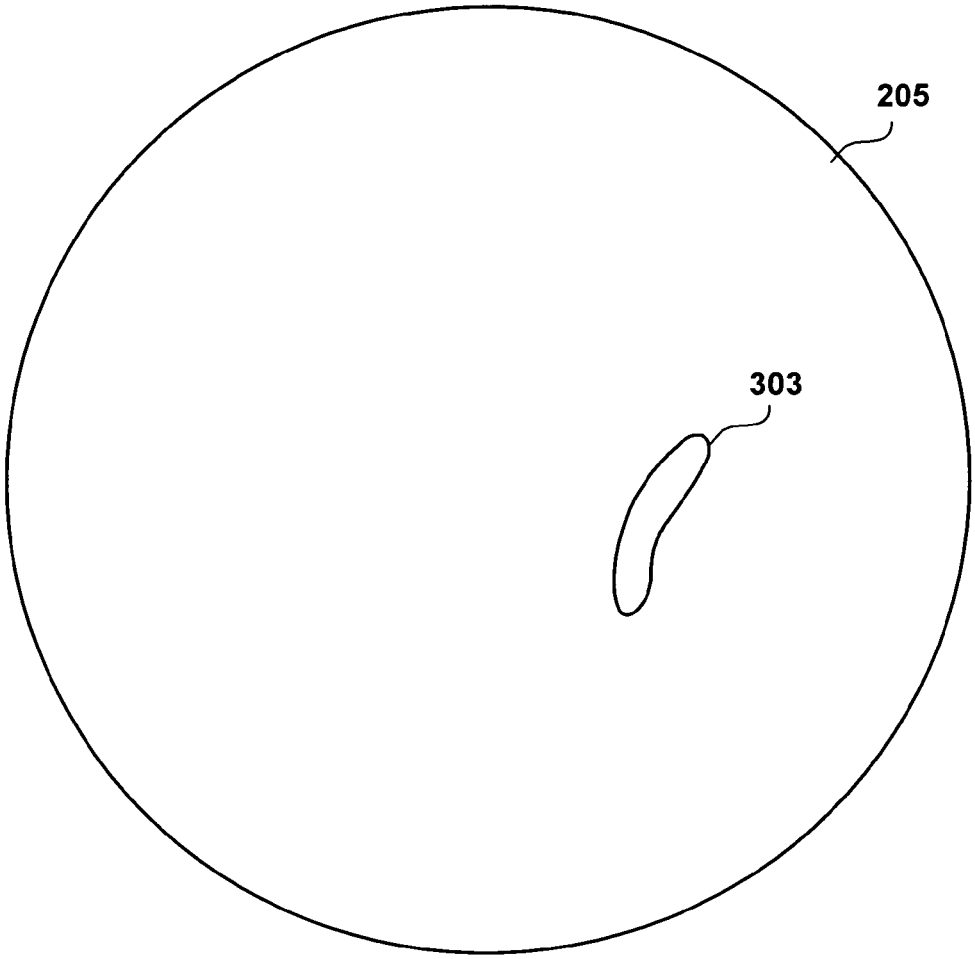
FIG. 3B is an illustration showing an overhead view of the wafer highlighting a contact area associated with an exemplary positioning of the grinding wheel, in accordance with one embodiment of the present invention.

FIG. 3B is an illustration showing an overhead view of the wafer 205 highlighting a contact area 303 associated with an exemplary positioning of the grinding wheel 211, in accordance with one embodiment of the present invention. It should be appreciated that a size and shape of the contact area 303 is dependent on the following factors: 1) a diameter of the grinding wheel 211, 2) a profile of the grinding wheel 211 working surface in contact with the wafer 205, and 3) an angle existing between the central axis of the grinding wheel 211 and the central axis of the chuck 201 extending in a substantially perpendicular manner to the wafer 205 through a centerpoint of the wafer 205.

Figure 3C:
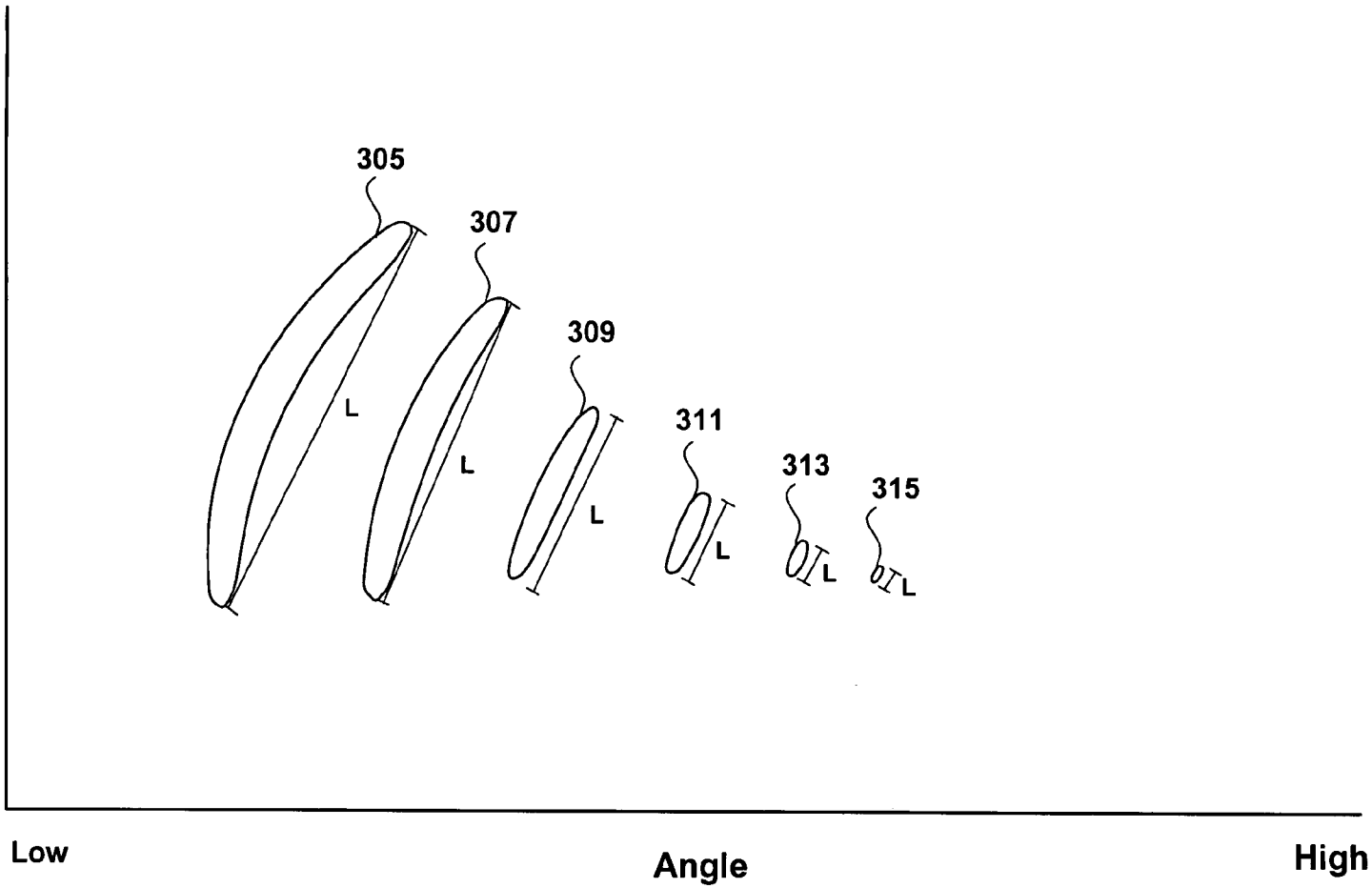
FIG. 3C is an illustration showing a variation in contact area between the grinding wheel and the wafer as the angle between the central axis of the grinding wheel and the central axis of the chuck is varied, in accordance with one embodiment of the present invention.

FIG. 3C is an illustration showing a variation in contact area between the grinding wheel 211 and the wafer 205 as the angle between the central axis of the grinding wheel 211 and the central axis of the chuck 201 is varied, in accordance with one embodiment of the present invention. As shown by the progression of contact area depictions 305–315, as the angle between the axes of the grinding wheel 211 and the chuck 201 is increased, the contact area becomes smaller. A length (L) of each contact area depiction 305–315, corresponding to a particular angle between the axes of the grinding wheel 211 and the chuck 201, is referred to as a planarization length. The planarization length essentially defines a segment of the wafer 205 surface that can be acted upon by the grinding wheel 211 at a particular instance in time. Therefore, the grinding wheel apparatus of the present invention allows for establishment of a variable planarization length to be used during wafer processing. Additionally, the grinding wheel apparatus allows a planarization length shorter than the wafer 205 diameter to be applied during the material removal process. For example, the grinding wheel apparatus can be configured to provide a planarization length that is approximately equal to a die pitch on the wafer 205. Configuring the grinding wheel apparatus to apply a shorter planarization length allows specific regions of the wafer 205 surface to be processed without concern for other regions of the wafer 205.

Also, as mentioned earlier, the fixed abrasive used in the grinding operation leaves only minimal scratches in the material layer present on the top surface of the wafer. Therefore, the grinding operation serves to establish a microtopography across the surface of the wafer, wherein the microtopography is defined by the scratch dimensions. Following the grinding operation, the resulting microtopography can be removed through a conventional chemical mechanical polishing (CMP) process. Since the grinding operation serves to eliminate the superfill regions present on the wafer surface, the subsequent CMP process will require less overpolishing, thus reducing the potential for detrimental erosion and dishing of regions on the wafer surface. In one embodiment, a self-stopping CMP process can be employed after the grinding operation to remove the microtopography produced by the grinding process on the wafer surface. The self-stopping CMP process is enabled through use of conventional CMP equipment and a particular slurry chemistry. Thus, use of the pre-planarization grinding, to impart the microtopography to the wafer surface, in combination with the particular slurry chemistry allows for a self-stopping CMP process in which the wafer is planarized in a substantially uniform manner with minimal dishing and erosion regardless of wafer type, pattern layout, and pattern density.

Figure 4:
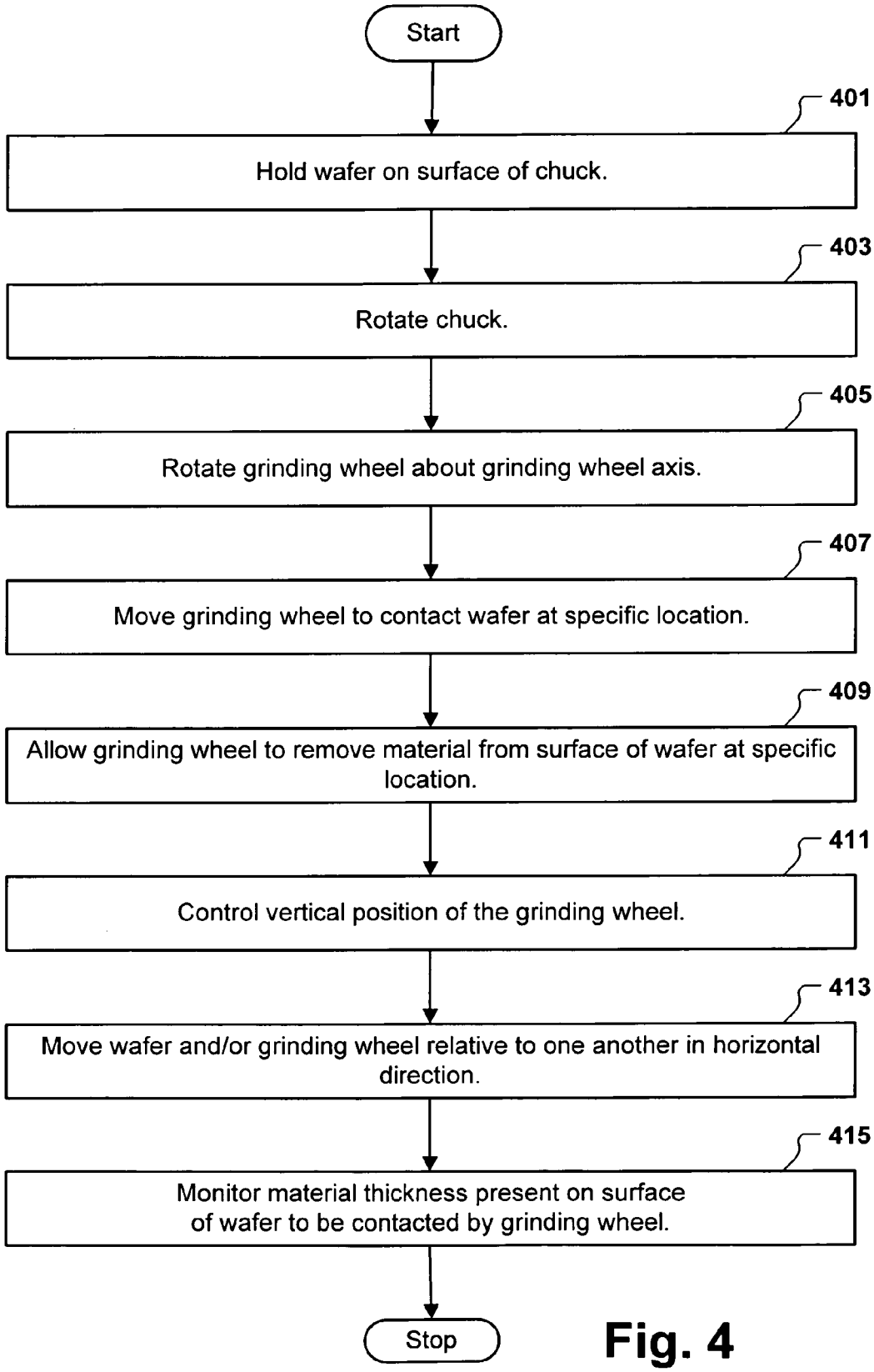
FIG. 4 is an illustration showing a flowchart of a method for pre-planarizing a semiconductor wafer, in accordance with one embodiment of the present invention.

FIG. 4 is an illustration showing a flowchart of a method for pre-planarizing a semiconductor wafer, in accordance with one embodiment of the present invention. The method includes an operation 401 for holding a wafer on a surface of a chuck. In an operation 403 the chuck is rotated, thus causing the wafer to be rotated with the chuck. In one embodiment, the chuck is rotated at a rate within a range extending up to about 200 RPM. An operation 405 is provided for rotating a grinding wheel about a grinding wheel axis. It should be appreciated that the grinding wheel axis is oriented to be non-perpendicular to the surface of the chuck upon which the wafer is held. In one embodiment, the grinding wheel is rotated at a rate within a range extending from about 300 RPM to about 40000 RPM.

The method further includes an operation 407 for moving the grinding wheel to contact the wafer at a specific location. The grinding wheel is defined to have a working surface for contacting the wafer. The working surface includes exposed fixed abrasive material secured within a binding matrix. In one embodiment, the working surface is defined to have a curved profile. An operation 409 is provided for allowing the grinding wheel to remove material from the surface of the wafer at the specific location of contact between the grinding wheel and the wafer. It should be appreciated that the material is removed from the wafer by contact that is made between wafer and the moving fixed abrasive material present at the working surface of the rotating grinding wheel. In one embodiment, a fluid rinse can be applied to the wafer surface to cool the wafer and transport removed wafer material from the wafer surface. In one embodiment, the fluid used to provide the fluid rinse is preferably an inert material such as deionized water.

The method also includes an operation 411 for controlling a vertical position of the grinding wheel such that a distance between the grinding wheel and the surface of the chuck on which the wafer is held is maintained within a tolerance of less than 0.1 micrometer. The method can also include an operation 413 for moving the wafer and/or grinding wheel relative to one another in a horizontal direction, i.e., parallel to the chuck surface upon which the wafer is being held. For example, in one embodiment, the chuck can be moved in a horizontal direction relative to the grinding wheel. In another embodiment, the grinding wheel can be moved in a horizontal direction relative to the chuck. In yet another embodiment, both the chuck and grinding wheel can be moved in a simultaneous manner. The method can further include an operation 415 for monitoring a material thickness present on the surface of the wafer to be contacted by the grinding wheel. The monitored material thickness can be used in a closed-loop control approach in which feedback is provided for controlling a vertical position of the grinding wheel relative to the surface of the chuck on which the wafer is held. The monitored material thickness can also be used to provide site-specific control based on the measurement made by the metrology at a particular site prior to rotation of the particular site into the grinding wheel contact area. Thus, the monitoring can be used to ensure that an appropriate thickness of material is removed from the wafer by application of the grinding wheel according to instructions generated by the metrology system. While the above-described closed-loop control approach teaches real-time feedback to control the grinding process, a further embodiment incorporates a full-wafer measurement and provides a thickness map of the film prior to the grinding process. In this embodiment, the grinding process can remove material according to the thickness map provided by the full-wafer measurement, thus producing microtopography in a material film on the wafer with a specified remaining film thickness.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention.

What is claimed is:

1. An apparatus for removing a material from a semiconductor wafer, comprising:

a chuck configured to hold a semiconductor wafer, the chuck further configured to rotate about a central axis of the chuck; and a grinding wheel disposed over the chuck in a proximately adjustable manner relative to the semiconductor wafer to be held by the chuck, the grinding wheel being configured to rotate about a central axis of the grinding wheel, the central axis of the grinding wheel being non-parallel to the central axis of the chuck, the grinding wheel being capable of removing material from the semiconductor wafer at a contact area between the grinding wheel and the semiconductor wafer, wherein the grinding wheel includes a working surface configured to remove material from the semiconductor wafer, the working surface defined to have a curved profile in a plane coincident with the central axis of the grinding wheel.

2. An apparatus for removing material from a semiconductor wafer as recited in claim 1, wherein the contact area is defined to have a planarization length that is less than a diameter of the semiconductor wafer.

3. An apparatus for removing material from a semiconductor wafer as recited in claim 1, wherein the central axis of the grinding wheel is adjustable in an angular manner with respect to the central axis of the chuck.

4. An apparatus for removing material from a semiconductor wafer as recited in claim 1, wherein the working surface is defined by exposed fixed abrasive material secured within a binding matrix.

5. An apparatus for removing material from a semiconductor wafer as recited in claim 1, wherein the working surface is defined as a portion of a spherical surface.

6. An apparatus for removing material from a semiconductor wafer as recited in claim 5, wherein the contact area between the grinding wheel and the semiconductor wafer is defined by a radius of the grinding wheel, a radius of the curved profile of the working surface, and an angle between the central axis of the grinding wheel and the central axis of the chuck.

7. An apparatus for removing material from a semiconductor wafer as recited in claim 4, wherein the fixed abrasive material is configured to impart scratches to the semiconductor wafer, the scratches having a depth less than about 0.25 micrometer and a width less than about 2 micrometers.

8. An apparatus for removing material from a semiconductor wafer as recited in claim 1, wherein a shape of the grinding wheel is defined as either a solid disk, a semi-solid disk, a ring having spokes extending to a central hub, a toroidal wheel, or a spherical/hemi-spherical wheel.

9. An apparatus for removing material from a semiconductor wafer as recited in claim 1, wherein the grinding wheel is configured to rotate about the central axis of the grinding wheel at a rate within a range extending from about 300 revolutions per minute (RPM) to about 40000 RPM.

10. An apparatus for removing material from a semiconductor wafer as recited in claim 1, wherein the chuck is configured to rotate about the central axis of the chuck at a rate within a range extending up to about 200 revolutions per minute (RPM).

11. An apparatus for removing material from a semiconductor wafer as recited in claim 1, further comprising:

a vertical adjustment mechanism configured to maintain the grinding wheel at a specific height relative to the chuck.

12. An apparatus for removing material from a semiconductor wafer as recited in claim 11, wherein the specific height relative to the chuck can be controlled within a tolerance of less than 0.1 micrometer.

13. An apparatus for removing material from a semiconductor wafer as recited in claim 1, further comprising:

a horizontal adjustment mechanism configured to move the grinding wheel in a controlled manner in a horizontal direction relative to the chuck.

14. An apparatus for removing material from a semiconductor wafer as recited in claim 1, further comprising:

a horizontal adjustment mechanism configured to move the chuck in a controlled manner in a horizontal direction relative to the grinding wheel.

15. A system for establishing a microtopography across a semiconductor wafer, comprising:

a wafer support structure configured to hold a wafer and rotate the wafer about a centerpoint of the wafer support structure;

a grinding wheel configured to rotate about a grinding wheel axis that is non-perpendicular to the wafer support structure, the grinding wheel having a working surface defined to removal material from a surface of the wafer when positioned to contact the surface of the wafer; and metrology disposed to monitor the surface of the wafer, the metrology being defined to provide information descriptive of the surface of the wafer to be contacted by the working surface of the grinding wheel.

16. A system for establishing a microtopography across a semiconductor wafer as recited in claim 15, further comprising:

a vertical adjustment control configured to maintain the grinding wheel at a specific height relative to the wafer support structure.

17. A system for establishing a microtopography across a semiconductor wafer as recited in claim 16, wherein the specific height relative to the wafer support structure can be controlled within a tolerance of less than 0.1 micrometer.

18. A system for establishing a microtopography across a semiconductor wafer as recited in claim 16, wherein the metrology is configured to send feedback to the vertical adjustment control, the feedback providing information about a thickness of a material present on the surface of the wafer, the vertical adjustment control being configured to adjust a distance between the grinding wheel and the wafer support structure according to the feedback received from the metrology.

19. A system for establishing a microtopography across a semiconductor wafer as recited in claim 15, further comprising:

a horizontal adjustment control configured to control a horizontal relationship between the grinding wheel and the wafer support structure.

20. A system for establishing a microtopography across a semiconductor wafer as recited in claim 15, further comprising:

an angular adjustment control configured to control an angle between the grinding wheel axis and a direction perpendicular to a surface of the wafer support structure upon which the wafer is to be held.

21. A system for establishing a microtopography across a semiconductor wafer as recited in claim 15, further comprising:

a fluid dispenser configured to apply a fluid to the wafer, the fluid serving to cool and lubricate the wafer and transport material removed from the wafer off of the wafer.

22. A system for establishing a microtopography across a semiconductor wafer as recited in claim 21, wherein the fluid is deionized water.

23. A method for pre-planarizing a semiconductor wafer, comprising:

holding a wafer on a surface of a chuck;

rotating the chuck;

rotating a grinding wheel about a grinding wheel axis that is oriented to be non-perpendicular to the surface of the chuck upon which the wafer is held;

moving the grinding wheel to contact the wafer at a specific location;

allowing the grinding wheel to remove material from a surface of the wafer at the specific location; and applying a fluid to the surface of the wafer such that the wafer is cooled and removed material is transported from the surface of the wafer.

24. A method for pre-planarizing a semiconductor wafer as recited in claim 23, wherein the fluid is deionized water.

25. A method for pre-planarizing a semiconductor wafer as recited in claim 23, further comprising:

moving the chuck in a horizontal direction relative to the grinding wheel, the horizontal direction being parallel to the surface of the chuck on which the wafer is held.

26. A method for pre-planarizing a semiconductor wafer as recited in claim 23, further comprising:

moving the grinding wheel in a horizontal direction relative to the chuck, the horizontal direction being parallel to the surface of the chuck on which the wafer is held.

27. A method for pre-planarizing a semiconductor wafer as recited in claim 23, wherein the grinding wheel is rotated at a rate within a range extending from about 300 revolutions per minute (RPM) to about 40000 RPM.

28. A method for pre-planarizing a semiconductor wafer as recited in claim 23, wherein the chuck is rotated at a rate within a range extending up to about 200 revolutions per minute (RPM).

29. A method for pre-planarizing a semiconductor wafer as recited in claim 23, further comprising:

controlling a vertical position of the grinding wheel such that a distance between the grinding wheel and the surface of the chuck on which the wafer is held is maintained within a tolerance of less than 0.1 micrometer.

30. A method for pre-planarizing a semiconductor wafer as recited in claim 23, further comprising:

monitoring a material thickness present on the surface of the wafer to be contacted by the grinding wheel.

31. A method for pre-planarizing a semiconductor wafer as recited in claim 30, further comprising:

providing feedback from the monitoring to control a vertical position of the grinding wheel relative to the surface of the chuck on which the wafer is held.

32. A method for pre-planarizing a semiconductor wafer as recited in claim 23, wherein the grinding wheel includes a working surface for contacting the wafer at the specific location, the working surface being defined by exposed fixed abrasive material secured within a binding matrix, the working surface being further defined to have a curved profile.

* * * * *